United States Patent [19]

Chastain et al.

[11] Patent Number: 4,589,355

[45] Date of Patent: May 20, 1986

[54] PARTICULATE WASTE PRODUCT COMBUSTION SYSTEM

[75] Inventors: Charles E. Chastain; Donald R. King, both of Stuttgart, Ark.

[73] Assignee: PRM Energy Systems, Inc., Stuttgart, Ark.

[21] Appl. No.: 719,712

[22] Filed: Apr. 2, 1985

Related U.S. Application Data

[63] Continuation-in-part of Ser. No. 465,648, Feb. 10, 1983, Pat. No. 4,517,905.

[51] Int. Cl.[4] ..... F23G 5/00; F23G 7/00

[52] U.S. Cl. ..... 110/346; 110/245; 110/258; 110/259; 110/347

[58] Field of Search ..... 110/245, 263, 346, 347, 110/258, 259; 165/104.16; 122/4 D

[56] References Cited

U.S. PATENT DOCUMENTS

| | | | |
|---|---|---|---|
| 3,411,465 | 11/1968 | Shirai | 110/245 X |
| 3,865,053 | 2/1975 | Kolze et al. | 110/186 |
| 4,159,000 | 6/1979 | Iwasaki et al. | 110/244 |
| 4,308,806 | 1/1982 | Uemura et al. | 110/244 |

*Primary Examiner*—Edward G. Favors

*Attorney, Agent, or Firm*—Harvey B. Jacobson

[57] ABSTRACT

The carbon content of the residue from combustion of agricultural waste products and the fly ash content of the gaseous exhaust is controlled by regulated inflow of the combustion supporting air in a plurality of flow stream at different velocities to enhance fluidization of particulate feed in a bed being raked by a rotating sweep arm inducing radially outward movement of combustion residue into a collecting zone from which the residue enters a discharge duct. The particulate feed is dropped at location in the combustion chamber above the bed in alignment with the inflow stream of maximum velocity.

12 Claims, 6 Drawing Figures

PARTICULATE WASTE PRODUCT COMBUSTION SYSTEM

BACKGROUND OF THE INVENTION

This invention relates to the controlled incineration of agricultural waste products for utilization of the ash residue and gaseous exhaust, and includes improvements over the system disclosed and claimed in our prior co-pending application, Ser. No. 465,648, filed Feb. 10, 1983, now U.S. Pat. No. 4,517,905 with respect to which the present application is a continuation-in-part.

The disposal of waste or by-products from the processing of agricultural food crops, often involves the burning of such by-products to create many problems for the food producing industry. By-products such as rice and peanut hulls, wood chips, cotton seed, etc. are tough, woody and abrasive. Further, such by-products are variable in density and have a high silica content. Incineration of such by-products are expensive, consumes large quantities of energy and creates air pollution problems.

The controlled combustion of the foregoing type of waste or by-products has heretofore been attempted with little success from either an economic standpoint or from an ecological standpoint. Because of feed density variation, overfiring or underfiring often occurs during combustion resulting in unstable heat generation and exhaust gas quality that is not satisfactory for heat recovery purposes. For example, the introduction of a feed with high silica content into the combustion chamber of a burner, generates an exhaust stream with excessive fly ash causing damage to and deterioration of boiler tubes because of silica related abrasiveness. Prior burners are also unable to control the degree of burn and therefore lack flexibility for control of the ash content of the combustion residue as a marketable product.

It is therefore an important object to provide an economical combustion system for a variety of feeds without requiring pretreatment or prior expensive processing and to accommodate a wide variation in feed bulk density.

Another object is to provide a combustion system for such waste products whereby the ash content of the combustion residue may be controlled and the fly ash content of its gaseous exhaust minimized.

SUMMARY OF THE INVENTION

In accordance with the present invention, a particulate feed is fed into a combustion chamber at a regulated feed rate and mixed with air when discharged from a temperature cooled end portion of a stock feeding system at a central infeed location within the combustion chamber above a bed into which the particulate feed drops. Combustion supporting air is supplied to the combustion chamber at an overfire location above and from underfire location below the bed. Underfire axial inflows of air enter the combustion chamber through grate openings at velocities insufficient to fluidize the particulate material while undergoing combustion in the absence of a mechanical raking action. A water cooled radial sweep arm is rotated just above the bed support to rake and agitate the particulate solids through the fluidizing zone of the combustion chamber at a speed sufficient to mechanically fluidize the solids during combusition. The sweep arm is vertically adjustable to a height spaced above the fixed bed support to accommodate different types of particulate feed from heavy density rice hulls to light density cottonseed. The raking action of the sweep arm also induces radially outward movement of the particulate feed under centrifugal force toward a non-fluidized collection zone above an imperforate peripheral portion of the bed support. A residue discharge duct is connected to the imperforate portion of the bed support at one location within the collection zone and a material displacing paddle is connected to the radially outer end of the sweep arm for rotation therewith to displace the ash residue from the collection zone into the residue discharge duct.

Operation of the foregoing apparatus evolves a gaseous exhaust that flows past the infeed location to an upper exhaust duct which delivers an exhaust useful as a heating medium for boilers or the like. By control of the feed rate of the particulate feed and adjustment of the vertical spacing of the sweep arm above the bed support, the heat energy content of the exhaust may be varied to meet different requirements. Further, the carbon content of the ash residue may be varied by adjustment of underfire air inflow rates between limits, in order to meet different market requirements for disposal of the ash residue.

Underfire air inflow is conducted through the porous portion of the fixed bed support from at least two flow streams separated by a circular partition within an inflow compartment underlying the bed support. The inflow velocities of the two flow streams are selected at different levels through separate air valves so that the radially inner air inflow zone aligned below the infeed location conducts an upward inflow stream at a higher velocity than that in the other inflow zone.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
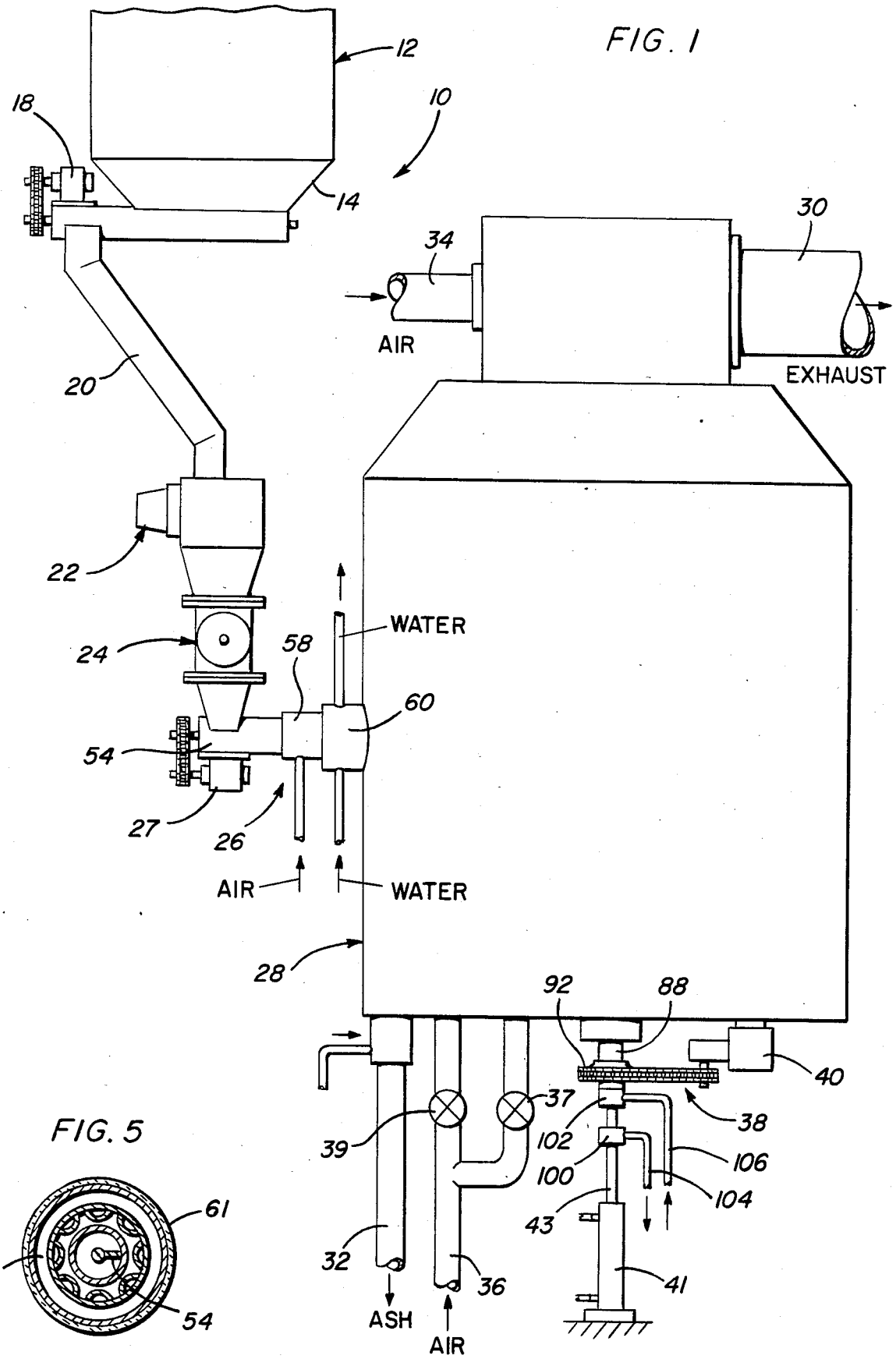
FIG. 1 is a simplified side elevational view of the apparatus associated with the system of the present invention.
Figure 5:
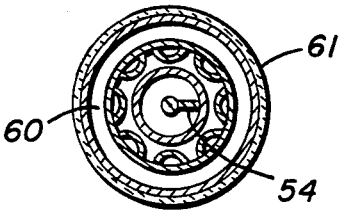
FIG. 5 is a partial transverse section view taken substantially through a plane indicated by section line 5—5 in FIG. 2.

Referring now to the drawings in detail, FIG. 1 illustrates typical apparatus for practicing the system of the present invention, generally referred to by reference numeral 10. A solid waste product is stored in a stock hopper 12 having a lower unloading end portion 14 from which particulate feed material enters an auger conveyor 16 attached to the hopper. The conveyor 16 is driven by a variable speed motor 18 to deliver the feed to the upper inlet end of a gravity duct 20 of generally rectangular cross-section. The lower delivery end of the duct 20 is connected to the housing of a flow meter 22 through which the feed passes into a rotary type of metering device 24. The flow meter 22 may be of a commercially available impact line type designed to measure the weight flow rate of the feed and generate an electrical signal reflecting such measurement. The signal output of the flow meter 22 is accordingly used to control drive of the variable speed motor 18 in order to maintain a substantially constant weight flow feed rate for the infeed mechanism generally referred to by reference numeral 26. The rotary metering device 24 is well known in the art and is utilized herein to prevent gas back-up.

The infeed mechanism 26 is driven by a variable speed motor 27 and extends into combustion chamber device, generally referred to by reference numeral 28. The products of combustion include a gaseous exhaust discharged through an exhaust duct 30 from the upper end of the combustion chamber device, and an ash residue withdrawn through a duct 32 from the lower end. Combustion supporting air is supplied through an overfire inflow duct 34 at the upper end and an underfire inflow duct 36 at the lower end. The underfire inflow is split between two inflow paths by inflow controlling air valves 37 and 39 through which air enters device 28 at two different velocities. A feed raking mechanism 38 is associated with the device 28 and extends from its lower end for drive by a variable speed motor 40. The mechanism is vertically adjustable through any suitable power operated adjusting device 41 from which a piston adjustment rod 43 extends.

Figure 6:
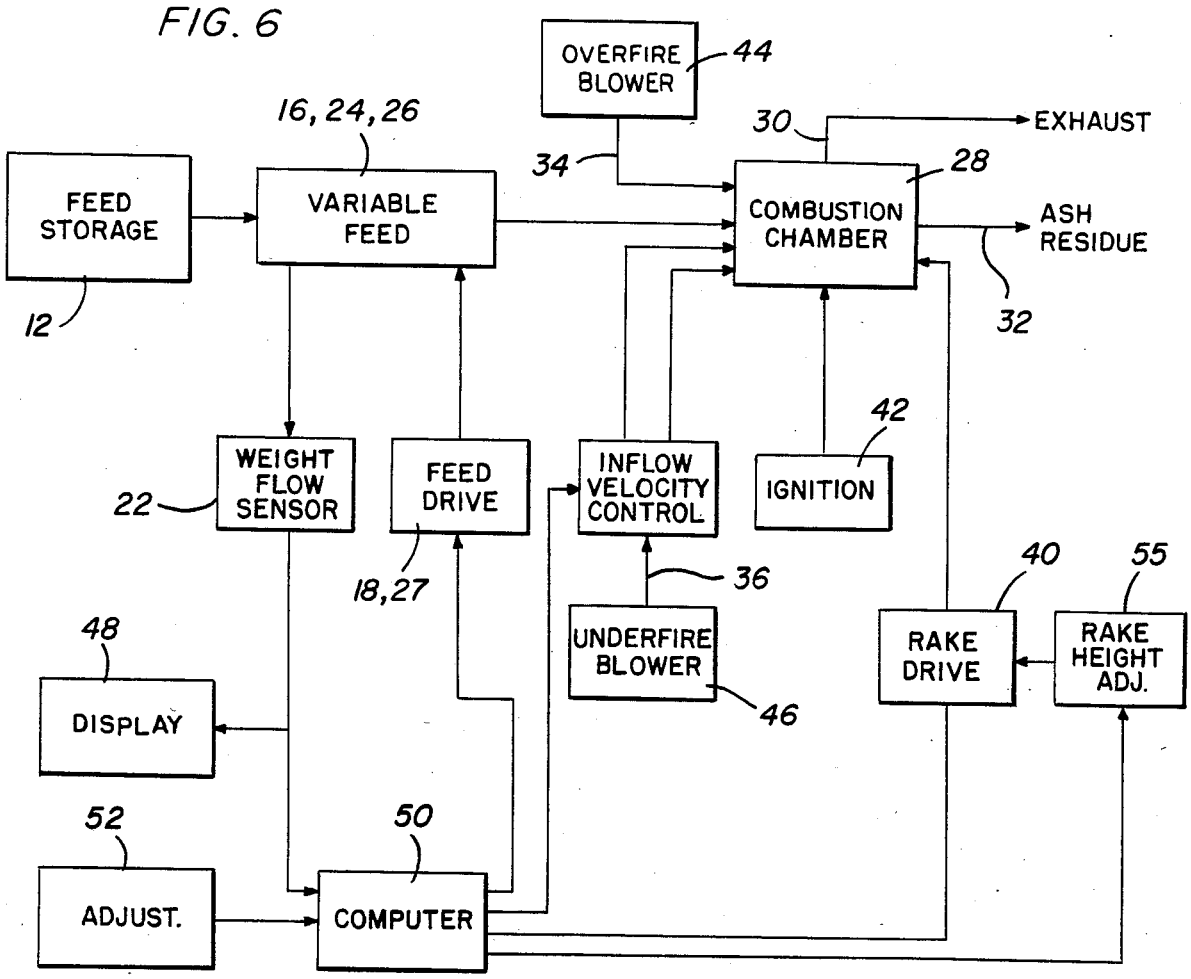
FIG. 6 is a block diagram schematically illustrating the system of the present invention in association with its controls.

The system with which apparatus 10 is associated, is diagrammed in FIG. 6 showing the flow of the particulate feed from storage 12 to the combustion chamber device 28 with which some form of igniting device 42 is associated. Also associated with combustion chamber device 28 are the rake drive motor 40 aforementioned, and blowers 44 and 46 for respectively supplying air through the overfire and underfire inflow ducts 34 and 36. The signal output of the flow meter 22 is fed to a visual display 48 and as an input to a computer 50 to which adjustment input data is also fed from 52. The computer produces outputs for control of the feed drives 18-26 in order to maintain an adjusted uniform weight flow rate for the feed into the combustion chamber. Underfire inflow velocities from blower 46, the vertical spacing of the sweep arm and its rotational speed may also be controlled by the computer through valve control 53, motor 40 and rake height adjustment control 55. The computer if utilized is thus programmed to control the feed rate, inflow velocities of the underfire air, and the height and speed of the rake in accordance with the present invention.

Figure 2:
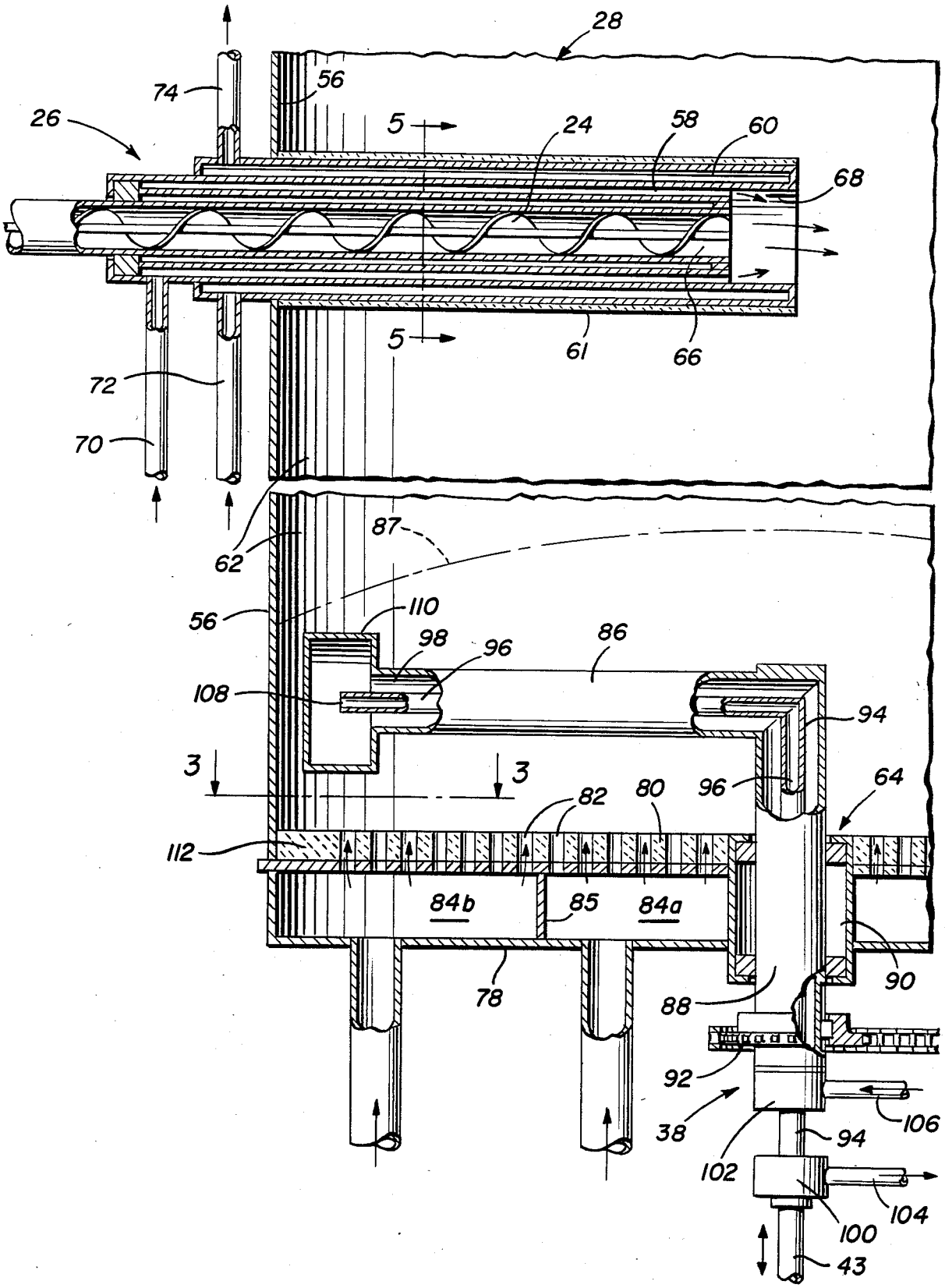
FIG. 2 is an enlarged partial side sectional view of the apparatus shown in FIG. 1.

Referring now to FIGS. 1 and 2, the infeed mechanism 26, includes an auger type conveyor 54 driven by the motor 27 externally of the housing 56 of the combustion chamber device 28. The conveyor 54 is enclosed by air passages 58 and an outer water jacket 60 that extend into the housing 56 with the conveyor 54 to cool the conveyor within the high temperature environment of the combustion chamber 62 enclosed by housing 56 above a fixed, horizontal bed support generally referred to by reference numeral 64. An insulating coating 61 is formed on the outer water cooling jacket 60 which extends axially beyond the discharge end 66 of the auger conveyor 54 to form a mixing space 68 at a central infeed location within the combustion chamber substantially aligned with the vertical longitudinal axis of the housing 56. The cooling air passages 58 open into the mixing space 68 so that air supplied thereto externally of the housing by conduit 70 will discharge into space 68 for mixing with the particulate feed being discharged from the delivery end 66 of the conveyor 54. The annular water space of jacket 60 is closed at its inner end for circulation of water between inlet and outlet conduits 72 and 74. Thus, air and water cooling of the conveyor 54 enables it to function continuously in discharging a mixture of air and particulate solids at a relatively hot central location in a thermal upflow of gaseous combustion products for decelerated gravitational descent toward the bed support 64. The space 68 not only provides for mixing of the particles with air before drop onto the bed, but also prevents back firing into the auger conveyor 54 and clears the discharge end thereof by the continued outflow of air from passages 58 when feed from the conveyor 54 is interrupted.

The bed support 64 as shown in FIG. 2 includes a steel gas distributor plate 76 spaced above the bottom wall 78 of the housing 56 and a refractory plate 80 fixed to the steel plate. A major radially inner porous portion of the plate 76 has closely spaced openings 82 to form a burner grate above an underfire compartment divided into two radially spaced inflow zones **84*a* and 84*b* to which the underfire air is conducted through the air valves 37 and 39 as aforementioned. Accordingly, the blower pressurized underfire air will be directed upwardly through the grate openings 82 under different velocities from two flow streams separated by a circular partition 85**.

The particulates which form the bed as shown by dotted line 87 in FIG. 2, are mechanically fluidized, during combustion, by the rake mechanism 38 which includes a radial sweep arm 86 extending through the fluidized zone from a rotor portion 88 supported by a sealed bearing assembly 90 for rotation about the vertical axis of the housing. The sweep arm will be adjustably spaced above the plate 76. The rotor 88 has a gear 92 splined thereto externally of the housing for driving connection to the motor 40. A conduit 94 extends concentrically through the rotor 88 and sweep arm 86 to form an inner return flow passage 96 and an annular inflow passage 98, respectively, connected through fixed manifolds 100 and 102 to coolant outlet and inlet conduits 104 and 106. The end 108 of inner conduit 94 opens into a hollow paddle formation 110 connected to the radially outer end of the sweep arm 86. The interior of the paddle is in communication with the annular passage 98 so that water will circulate through the sweep arm and paddle for cooling thereof.

Figure 3:
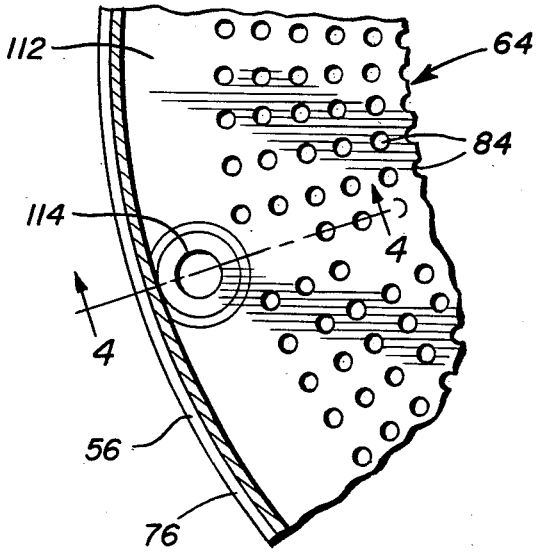
FIG. 3 is a partial section view taken substantially through a plane indicated by section line 3—3 in FIG. 2.

The paddle 110 is vertically spaced above a radially outer, imperforate portion 112 of the bed support 64 over which a non-fluidized collection zone is established. It will be apparent that rotation of the sweep arm through the rotor portion 88 of the mechanism 38 not only fluidizes material during combustion, but also induces radially outward movement thereof under centrifugal forces toward the non-fluidized collection zone above the annular imperforate portion 112 of the bed support. Thus, an ash residue is collected on portion 112 of the bed support and is displaced by the paddle 110 each revolution to the upper inlet end 114 of the residue discharge duct 32 as more clearly seen in FIGS. 3 and 4.

Figure 4:
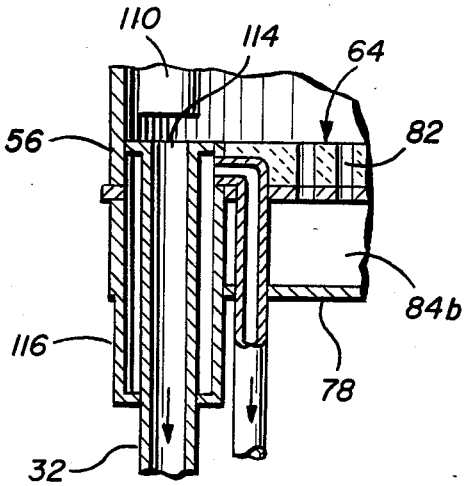
FIG. 4 is an enlarged partial section view taken substantially through a plane indicated by section line 4—4 in FIG. 3.

As shown in FIG. 4, a water cooling jacket 116 is mounted about the duct 32, which is connected at its upper inlet end to the imperforate portion 112 of the bed support 64. The inlet end 114 is furthermore aligned with the paddle which cyclically passes thereabove to effect withdrawal of the ash residue collected on the portion 112 of the bed support.

As a result of the arrangement of the apparatus hereinbefore described, the fly ash content and abrasiveness of the exhaust gas is minimal despite the use of a feed having a high silica content. The fly ash content of the exhaust gas is furthermore reduced by a lower velocity of the underfire inflow through the radially outer zone **84*b* aligned below the radially outer portion of the bed 87 which is thinned out by the raking action. The central portion of the bed 87, of maximum height because of its alignment with the central infeed location, is aligned with the radially inner inflow zone 84*a*** through which inflow air enters at a higher velocity. Because of the foregoing zoning of the underfire air, a fly ash reducing affect is realized which is particularly critical in accommodating the combustion of lightweight feeds such as cottonseed.

To accommodate heavier feeds such as rice hulls, the rake speed of the sweep arm and the height of the sweep arm above the plate 76 must be increased toward upper operational limits of 7.5 RPM and 13½" inches, respectively, for efficient combustion. For the lighter feeds, such as cottonseed, sweep arm height is lowered toward a lower limit of 5½ inches according to actual embodiments of the invention. Also, for lighter feeds dimensional increases in width and height of the sweep arm paddle 110 was found to be beneficial in enhancing the recovery of the ash residue. Variations in the aforementioned parameters, including sweep arm height and speed, paddle size and underfire inflow zone velocities also affect the carbon content of the ash residue in different ways which may thereby be tailored to meet different combinations of product requirements and feed characteristics.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with apparatus for incinerating combustible material within a fluidized bed, including the steps of: feeding the material into a fluidizing zone within which the bed is formed; introducing combustion supporting gas to said fluidizing zone in a plurality of inflow streams of different velocities insufficient to fluidize the material; continuously agitating the material to mechanically fluidize the same within said fluidizing zone during combustion and cause displacement of residual ash from the zone; and withdrawing the residual ash from a discharge location in the apparatus outside of the fluidizing zone.

2. The method of claim 1 wherein the material is fed into the fluidizing zone from an infeed location aligned with one of the inflow streams of maximum velocity.

3. The method of claim 2 wherein the material is particulate agricultural by-products.

4. The method of claim 3 wherein said by-products are of a class of high silica content particles, including rice hulls and cottonseed.

5. In combination with apparatus for incinerating combustible material within a fluidized bed, including a combustion chamber housing, a bed support within the housing above which a fluidizing zone is formed and below which an underfire compartment is formed, and a rake rotatably mounted within the fluidizing zone spaced above the bed support, the improvement comprising infeed means for introducing the material into the combustion chamber from an infeed location therein above the fluidizing zone, inflow means for upwardly conducting combustion supporting gas into the fluidizing zone through the bed support from at least two flow streams under different inflow velocities insufficient to fluidize the material, and drive means operatively connected to the rake for continuous rotation thereof at a predetermined speed effective to mechanically fluidize the material within said fluidizing zone during combustion and cause displacement of residual ash from the fluidizing zone.

6. The improvement as defined in claim 5 wherein the inflow means includes partition means for dividing the underfire compartment into radially spaced inflow zones through which the two flow streams are conducted.

7. The improvement as defined in claim 6 wherein the inflow means further includes an underfire blower from which pressurized flow of the gas originates and a pair of flow controlling valve devices operatively connected to the blower for supply of the pressurized gas to the inflow zones at the different inflow velocities, respectively.

8. The improvement as defined in claim 7 wherein the inflow velocity of the gas conducted through one of the inflow zones, vertically aligned with the infeed location, is higher than that in the other of the inflow zones.

9. The improvement as defined in claim 8 including means for selectively adjusting the spacing between the rake and the bed support.

10. The improvement as defined in claim 6 wherein the inflow velocity of the gas conducted through one of the inflow zones, vertically aligned with the infeed location, is higher than that in the other of the inflow zones.

11. The improvement as defined in claim 5 including means for selectively adjusting the spacing between the rake and the bed support.

12. In combination with apparatus for incinerating combustible material within a fluidized bed, including a combustion chamber housing, a bed support within the housing above which a fluidizing zone is formed and below which an underfire compartment is formed, and a rake rotatably mounted within the fluidizing zone spaced above the bed support, the improvement comprising infeed means for introducing the material into the combustion chamber housing from an infeed location therein aligned above the fluidizing zone, inflow means for upwardly conducting combustion supporting gas into the fluidizing zone through the underfire compartment under a maximum velocity insufficient to fluidize the material, drive means operatively connected to the rake for continuous rotation thereof at a predetermined speed effective to mechanically fluidize the material within said fluidizing zone during combustion and cause displacement of residual ash from the fluidizing zone, and means for selectively adjusting the spacing between the rake and the bed support.

* * * * *